United States Patent [19]

Uehara et al.

[11] Patent Number: 4,882,124

[45] Date of Patent: Nov. 21, 1989

[54] ALLOYS HAVING EXCELLENT EROSION RESISTANCE

[75] Inventors: Toshihiro Uehara; Rikizo Watanabe, both of Yasugi, Japan

[73] Assignee: Extra-Ministerial Bureau of Ministry of Trade & Industry Agency of Industrial Science & Technology, Tokyo, Japan

[21] Appl. No.: 256,214

[22] Filed: Oct. 11, 1988

Related U.S. Application Data

[63] Continuation-in-part of Ser. No. 166,325, Mar. 11, 1988, abandoned.

[30] Foreign Application Priority Data

| | | | |
|---|---|---|---|
| Jun. 18, 1987 | [JP] | Japan | 62-150174 |
| Mar. 14, 1988 | [DE] | Fed. Rep. of Germany | 3808451 |
| Mar. 14, 1988 | [FR] | France | 88 03287 |
| Mar. 15, 1988 | [SE] | Sweden | 8800919 |
| Mar. 15, 1988 | [GB] | United Kingdom | 8806125 |

[51] Int. Cl.[4] ..... C22C 38/38

[52] U.S. Cl. ..... 420/74; 420/56; 420/70

[58] Field of Search ..... 420/56, 74, 70

[56] References Cited

FOREIGN PATENT DOCUMENTS

| | | | |
|---|---|---|---|
| 50-10527 | 4/1975 | Japan | 420/74 |
| 676636 | 7/1979 | U.S.S.R. | 420/12 |
| 869010 | 5/1961 | United Kingdom | 420/56 |

*Primary Examiner*—Deborah Yee

*Attorney, Agent, or Firm*—Schmeiser, Morelle & Watts

[57] ABSTRACT

The alloys of this invention illustrate good property on erosion resistance. The compositions of these alloys are C: more than 0.09 wt. % and less than 1.7 wt. %, Si: 2.5 wt. % or less, Mn: 10–25 wt. %, Cr: 6–20 wt. %, V: more than 4 wt. % and less than 7 wt. % , N: 0.1 wt. % or less, and Fe: the rest. Optional small content is Ni and /or Mo.

2 Claims, No Drawings

ALLOYS HAVING EXCELLENT EROSION RESISTANCE

This application is a continuation-in-part of U.S. Application Ser. No.: 166,325, filed on Mar. 11, 1988, now abandoned.

BACKGROUND OF THE INVENTION

1. Field of the Invention

The present invention relates to alloys having excellent erosion resistance and suitable, for example, for use in instruments and parts such as erosion shields of turbines, valves, etc., which are susceptible to fluid erosion.

2. Description of the Prior Art

Stellites which are Co—Cr—W—C base alloys having very excellent erosion resistance and mechanical strength are now used as main materials for instruments and parts such as the erosion shields and valve seats of atomic power plants which are occasionally subject to erosion.

Stellites, however, contain a high percentage of cobalt and have caused troubles on radioactivity resulting from radioactivation of cobalt when the stellites are used for atomic power plants.

Japanese Laid-Open Patent No. 60865/1986 discloses cavitation-erosion resistant alloys comprising 10–30 wt.% of manganese, 10–30 wt.% of chromium, 0.5–3.0 wt.% of vanadium, not more than 0.3 wt.% of carbon, 0.2–1.0 wt.% of nitrogen and the balance essentially consisting of iron. However, according to the examination of the inventors, alloys having a high content of nitrogen such as those disclosed in Japanese Laid-Open Patent No. 60865/1986 result in too much stabilization of austenite. In addition, vanadium nitride is preferentially precipitated in the course of aging treatment and it becomes difficult to retain vanadium carbide which is effective for the enhancement of erosion resistance. As a result of above two reasons, good erosion resistance has not yet been obtained. That is, a high manganese-chromium-iron base alloy in combination with enhancement in the precipitation of vanadium carbide is the requirement for obtaining good erosion resistance.

SUMMARY OF THE INVENTION

The object of this invention is, in consideration of these problems, to provide alloys which are free from cobalt and excellent in erosion resistance and mechanical strength.

The excellent erosion resistance of stellites may be considered as a result of absorbing impact force through the martensitic transformation of crystalline structure from face-centered cubic system to hexagonal close-packed system. Therefore, in order to overcome the aforesaid problem, the present inventors have given much attention to and have extensively investigated ferroalloys of high manganese content other than cobalt-base alloys which are liable to cause such transformation. As a result, Fe-Mn-Cr base alloys have newly been found to be promising. Furthermore it has been experimentally found that strengthening of the Fe-Mn-Cr base alloys by vanadium carbide is effective for the enhancement of erosion resistance. Thus the present invention has been achieved.

That is, one aspect of the present invention is an alloy having excellent erosion resistance which comprises more than 0.90 wt.% and less than 1.7 wt.% of carbon, not more than 2.5 wt.% of silicon, 10–25 wt.% of manganese, 6–20 wt.% of chromium, more than 4 wt.% and less than 7 wt.% of vanadium, not more than 0.1 wt.% of nitrogen and the balance essentially consisting of iron. Another aspect of the present invention is an alloy having superior erosion resistance which is obtained by alloying at least one of nickel and molybdenum with the above alloy, nickel being not more than 3 wt.% and molybdenum not more than 4 wt.% of the alloy.

DETAILED DESCRIPTION OF THE INVENTION

Embodiments of the invention will not be explained in one detail by way of example only in the following description.

Since carbon forms vanadium carbide, carbon is a required element for enhancing erosion resistance and mechanical strength. When carbon content is less than 0.90 wt.%, a minor effect is obtained because of too small quantity of carbide. On the other hand, an adverse effect on corrosion resistance result from a carbon content of more than 1.7 wt.%. Therefore preferred carbon content is in the range of more than 0.90 wt.% and less than 1.7 wt.%.

Although silicon is an effective element as a deoxidizer, further improvement in the deoxidation cannot be expected even in an amount exceeding 2.5 wt.%. Therefore maximum silicon content is preferably 2.5 wt.%.

Manganese stabilizes the austenite and absorbs impact force by permitting martensitic ($\epsilon$-martensitic) transformation through the impact of fluid. Thus manganese is a required element for improving erosion resistance. When manganese content is less than 10 wt.%, the austenite becomes unstable and ferrite or martensite is formed. Consequently the amount of martensitic transformation is reduced and erosion resistance is deteriorated. On the other hand, when the manganese content is more than 25 wt.%, the austenite is too much stabilized. Consequently the martensitic transformation becomes difficult to take place and erosion resistance deteriorates. Therefore the preferred content of manganese is in the range of 10–25 wt.%.

Chromium is a required element for enhancing erosion resistance as well as corrosion resistance. When chromium content is less than 6 wt.%, corrosion resistance deteriorates in particular. When the chromium content is more than 20 wt.%, ferrite or $\delta$-phase is apt to form and erosion resistance deteriorates. Therefore the content of chromium is preferably in the range of 6–20 wt.%.

Vanadium forms carbide and is a required element for enhancing mechanical strength and erosion resistance. A minor effect is obtained when vanadium content is less than 4 wt.% whereas an adverse effect on hot working characteristics is caused when the vanadium content is more than 7 wt.%. Consequently the preferred vanadium content is in the range of more than 4 wt.% and less than 7 wt.%.

Nitrogen is an element which is liable to contaminate as an impurity in high manganese alloys. Nitrogen forms nitride with vanadium and inhibits formation of vanadium carbide. Since nitrogen causes no problem in practical application in an amount of 0.1 wt.% or less, the content of not more than 0.1 wt.% is preferable.

Nickel is an element which is similarly effective as manganese for the stabilization of austenite. When the nickel content exceeds 3 wt.%, the austenite is too much stabilized and erosion resistance deteriorates. Therefore the maximum content of nickel is 3 wt.%.

Molybdenum is an element effective for improving mechanical strength and corrosion resistance. Since toughness is deteriorated by the presence of molybdenum above 4 wt.%, the maximum content of molybdenum is 4 wt.%.

The alloys of this invention do not contain cobalt and are excellent in erosion resistance and mechanical strength. Therefore these alloys can be applied to the materials of instruments and parts such as erosion shields of turbine blades and valves which tend to undergo erosion in the atomic power plants. These alloys have industrially remarkable advantages such as no radioactivity problems, low cost and less damage due to erosion.

EXAMPLES

The present invention will hereinafter be described by way of illustrative examples.

Among the alloys having compositions illustrated in Table 1, inventive alloys of sample Nos. 1–18 and comparative alloys of sample Nos. 19–24 were melted in a high-frequency induction furnace to prepare ingots having a weight of 10 kg. All ingots were finished by hot working to obtain bars having a square section of 30 mm. Test pieces were prepared from these bars, heat treated and subjected to specimen working. The heat treatment conditions of the inventive alloys Nos. 1–18 and those of comparative alloys were as follows. The alloys were heated at 1150° C. for an hour to form solid solutions, cooled with water, followed by an aging treatment at 750° C. for 1–2 hours and cooled in air. As to the conventional alloys, No. 25 is SUS 304, No. 26 is SUS 202, No. 27 is 13 chromium high-temperature steel and No. 28 is a stellite. Table-2 illustrates the results of these test pieces measured on the weight loss due to cavitation-erosion, and 0.2% proof stress and tensile strength in the tensile test. Erosion resistance was evaluated by the weight loss in the cavitation-erosion test. The testing conditions were in accordance with the method of the Japan Society of the Promotion of Science except that vibrational frequency was 6.5 kHz, amplitude was 90 μm, test liquid was pure water at 50° C. and testing time was 4 hours.

As clearly illustrated in Table-2, the alloys of this invention have a very small loss in cavitationerosion as compared with the comparative alloy Nos. 19–24 and also have a loss of 10.9 mg or less similarly to that of the stellite in conventional alloys. Very excellent erosion resistance is recognized by these data.

Table 2 illustrates that the inventive alloy of sample No. 16, in particular, exhibits further superior erosion resistance to the conventional alloy of sample No. 28 which is excellent in erosion resistance. Furthermore, the alloys of this invention have also a high mechanical strength such as 0.2% proof stress and tensile strength which are higher than those of conventional alloys.

In addition, stress-corrosion cracking test was conducted in a 20% aqueous $MgCl_2$ solution at 50° C. under application of tensile stress. Table-3 illustrates the test results on the alloys of this invention No. 10 as well as conventional alloy No. 28. The results shows that the alloys of this invention have outstanding resistance to stress-corrosion cracking as compared with conventional alloy.

TABLE 1

| Sample No. | Chemical composition (wt.%) | | | | | | | | | Note |
|---|---|---|---|---|---|---|---|---|---|---|
| | C | Si | Mn | Ni | Cr | Mo | V | Fe | N | |
| 1 | 1.01 | 0.37 | 15.01 | — | 9.99 | — | 4.24 | rest | 0.042 | Inventive alloy |
| 2 | 1.43 | 0.40 | 14.50 | — | 9.81 | — | 6.45 | " | 0.047 | " |
| 3 | 0.98 | 0.38 | 15.81 | — | 10.07 | 2.01 | 4.10 | " | 0.035 | " |
| 4 | 0.97 | 0.35 | 15.35 | — | 10.17 | — | 4.46 | " | 0.055 | " |
| 5 | 0.92 | 0.29 | 18.07 | — | 9.75 | — | 4.14 | " | 0.043 | " |
| 6 | 0.93 | 0.29 | 18.38 | — | 9.91 | 1.03 | 4.03 | " | 0.039 | " |
| 7 | 0.92 | 0.31 | 18.32 | — | 9.80 | 3.00 | 4.06 | " | 0.050 | " |
| 8 | 0.92 | 0.31 | 16.82 | — | 9.75 | — | 4.37 | " | 0.030 | " |
| 9 | 0.94 | 0.31 | 18.71 | 1.92 | 14.22 | — | 4.03 | " | 0.053 | " |
| 10 | 0.97 | 0.34 | 15.23 | — | 10.11 | 0.01 | 4.33 | " | 0.051 | " |
| 11 | 0.91 | 0.34 | 18.16 | — | 10.25 | — | 4.14 | " | 0.055 | " |
| 12 | 0.97 | 0.35 | 18.47 | — | 16.57 | — | 4.27 | " | 0.100 | " |
| 13 | 0.95 | 0.38 | 17.86 | — | 10.36 | — | 4.17 | " | 0.0027 | " |
| 14 | 0.91 | 0.38 | 17.96 | — | 12.14 | — | 4.24 | " | 0.0025 | " |
| 15 | 0.96 | 0.38 | 17.87 | — | 14.51 | — | 4.23 | " | 0.0040 | " |
| 16 | 0.93 | 0.37 | 18.01 | — | 10.10 | — | 4.18 | " | 0.043 | " |
| 17 | 0.96 | 0.35 | 18.21 | — | 12.16 | — | 4.09 | rest | 0.051 | Inventive alloy |
| 18 | 0.97 | 0.36 | 18.36 | — | 14.42 | — | 4.24 | " | 0.066 | " |
| 19 | 0.56 | 0.32 | 15.30 | 0.01 | 20.06 | — | 1.98 | " | 0.45 | Comparative alloy |
| 20 | 0.57 | 0.32 | 25.29 | 0.02 | 15.07 | — | 2.10 | " | 0.036 | " |
| 21 | 0.54 | 1.14 | 15.37 | 0.01 | 10.19 | 0.01 | 2.02 | " | 0.37 | " |
| 22 | 0.055 | 1.01 | 14.89 | — | 9.97 | — | 2.02 | " | 0.42 | " |
| 23 | 0.54 | 1.06 | 10.12 | 4.98 | 10.02 | — | 1.97 | " | 0.059 | " |
| 24 | 0.12 | 0.22 | 14.54 | — | 9.85 | — | 0.03 | " | 0.066 | " |
| 25 | 0.017 | 0.50 | 0.74 | 9.50 | 18.5 | — | — | " | — | Conventional alloy |
| 26 | 0.084 | 0.44 | 8.55 | 4.96 | 17.7 | — | — | " | 0.24 | " |
| 27 | 0.11 | 0.44 | 0.43 | 1.51 | 12.87 | 1.52 | — | " | — | " |
| 28 | 1.11 | 0.61 | 1.51 | 2.25 | 29.1 | W 4.06 | Co rest | 1.02 | — | " |

TABLE 2

| Sample No. | Cavitation-erosion loss (after 4 hours) (mg) | 0.2% Proof stress ($kgf/mm^2$) | Tensile strength ($kgf/mm^2$) |
|---|---|---|---|
| 1 | 2.6 | 91.0 | 136.7 |
| 2 | 3.1 | 92.6 | 142.3 |

TABLE 2-continued

| Sample No. | Cavitation-erosion loss (after 4 hours) (mg) | 0.2% Proof stress ($kgf/mm^2$) | Tensile strength ($kgf/mm^2$) |
|---|---|---|---|
| 3 | 2.4 | 96.3 | 136.2 |
| 4 | 2.7 | 83.7 | 129.9 |
| 5 | 3.1 | 92.8 | 133.2 |
| 6 | 3.6 | 100.0 | 136.6 |
| 7 | 5.7 | 107.4 | 141.1 |
| 8 | 2.7 | 86.7 | 127.0 |
| 9 | 10.9 | 94.4 | 125.3 |
| 10 | 4.4 | 85.5 | 135.4 |
| 11 | 3.0 | 94.2 | 135.6 |
| 12 | 9.5 | 82.8 | 119.4 |
| 13 | 2.3 | 97.9 | 137.0 |
| 14 | 3.4 | 93.7 | 130.7 |
| 15 | 6.9 | 81.4 | 122.4 |
| 16 | 2.2 | 96.5 | 135.3 |
| 17 | 4.1 | 94.9 | 132.8 |
| 18 | 4.0 | 95.2 | 132.0 |
| 19 | 12.3 | 99.8 | 130.0 |
| 20 | 26.5 | 85.3 | 114.1 |
| 21 | 12.6 | 85.8 | 122.3 |
| 22 | 21.4 | 37.8 | 103.2 |
| 23 | 17.8 | 86.5 | 118.5 |
| 24 | 15.7 | 25.7 | 109.3 |
| 25 | 97.1 | 19.1 | 60.8 |
| 26 | 34.1 | 40.1 | 75.9 |
| 27 | 45.3 | 85.9 | 104.9 |
| 28 | 3.5 | 62.7 | 111.1 |

TABLE 3

| Sample No. | Stress ($kgf/mm^2$) | Ratio to tensile strength | Stress-corrosion cracking time (h) (20% $MgCl_2$, 50° C.) | Note |
|---|---|---|---|---|
| 10 | 122 | 0.9 | 4.3 | Inventive alloy |
| 28 | 89 | 0.8 | 1.0 | Conventional alloy |
| | 100 | 0.9 | 0.4 | " |

What is claimed is:

1. An alloy having excellent erosion resistance which comprises more than 0.90 wt.% and less than 1.7 wt.% of carbon, not more than 2.5 wt.% of silicon, from 10 to 25 wt.% of manganese, from 6 to 20 wt.% of chromium, more than 4 wt.% and less than 7 wt.% of vanadium, not more than 0.1 wt.% of nitrogen and the balance essentially consisting of iron.

2. An alloy having superior erosion resistance which comprises at least one of not more than 3 wt.% of nickel and not more than 4 wt.% of molybdenum alloyed with an alloy containing more than 0.90 wt.% and less than 1.7 wt.% of carbon, not more than 2.5 wt.% of silicon, from 10 to 25 wt.% of manganese, from 6 to 20 wt.% of chromium, more than 4 wt.% and less than 7 wt.% vanadium, not more than 0.1 wt.% of nitrogen and the balance essentially consisting of iron.

* * * * *